US008479958B1

(12) United States Patent
Swift

(10) Patent No.: US 8,479,958 B1
(45) Date of Patent: Jul. 9, 2013

(54) CARRYING BAG

(76) Inventor: Halbert Swift, Columbia, SC (US)

( * ) Notice: Subject to any disclaimer, the term of this patent is extended or adjusted under 35 U.S.C. 154(b) by 0 days.

(21) Appl. No.: 12/960,211

(22) Filed: Dec. 3, 2010

(51) Int. Cl.
*A45F 3/14* (2006.01)
*A45F 3/04* (2006.01)
*A45F 3/00* (2006.01)

(52) U.S. Cl.
USPC ..... 224/257; 224/258; 224/259; 224/647; 224/649

(58) Field of Classification Search
USPC ..... 224/257, 258, 259, 646, 647, 648, 224/649, 650, 262, 637, 901.4, 930
See application file for complete search history.

(56) References Cited

U.S. PATENT DOCUMENTS

| | | | | | |
|---|---|---|---|---|---|
| 1,884,328 | A | * | 10/1932 | Sperling | 224/587 |
| 2,396,118 | A | * | 3/1946 | Ohlemeyer | 224/198 |
| 3,648,906 | A | * | 3/1972 | Ross | 224/605 |
| 3,739,961 | A | * | 6/1973 | Soukeras | 224/579 |
| D245,461 | S | * | 8/1977 | Jones, Jr. | D3/230 |
| 4,346,827 | A | * | 8/1982 | Bianchi et al. | 224/624 |
| 4,750,652 | A | * | 6/1988 | Grant | 224/627 |
| 4,903,874 | A | * | 2/1990 | Shoemaker | 224/624 |
| 5,246,153 | A | * | 9/1993 | Beletsky | 224/192 |
| 5,263,618 | A | * | 11/1993 | Talavera | 224/148.5 |
| 5,358,159 | A | * | 10/1994 | Lundie, Jr. | 224/624 |
| 5,361,953 | A | * | 11/1994 | Nichols | 224/198 |
| 5,533,655 | A | * | 7/1996 | Duque | 224/602 |
| D373,018 | S | * | 8/1996 | Alberti | D3/218 |
| 5,586,704 | A | * | 12/1996 | Alexander et al. | 224/605 |
| 5,653,367 | A | * | 8/1997 | Abramson | 224/581 |
| 5,687,896 | A | | 11/1997 | Clift | |
| 5,775,558 | A | * | 7/1998 | Montalbano | 224/627 |
| 5,816,460 | A | * | 10/1998 | Cook | 224/260 |
| D411,916 | S | * | 7/1999 | Jackson | D3/218 |
| 6,016,944 | A | * | 1/2000 | Girbert | 224/646 |
| 6,209,769 | B1 | * | 4/2001 | Seals et al. | 224/583 |
| 6,390,346 | B1 | * | 5/2002 | Thomas | 224/605 |
| D467,417 | S | * | 12/2002 | Jackson | D3/218 |
| 6,543,661 | B1 | * | 4/2003 | Lazur | 224/604 |
| 6,568,575 | B1 | * | 5/2003 | Bartholomew | 224/583 |
| 6,892,914 | B2 | * | 5/2005 | Girbert | 224/625 |
| D547,943 | S | * | 8/2007 | Menzel | D3/222 |
| D561,464 | S | * | 2/2008 | Courtney | D3/218 |
| 7,370,781 | B2 | * | 5/2008 | Gambrill | 224/647 |
| D574,608 | S | * | 8/2008 | Menzel et al. | D3/215 |

* cited by examiner

*Primary Examiner* — Justin Larson
*Assistant Examiner* — Lester L Vanterpool

(57) ABSTRACT

A carrying bag including an adjustable shoulder strap as well as an adjustable secondary strap that fits across a wearer's back and around an arm opposite the shoulder strap and that has a pouch integrally attached to a carrier body thereof, the pouch accessible by both a zipper and through an opening having a flap thereover. A waist belt is also provided as an additional way to secure the carrying bag to a wearer.

4 Claims, 3 Drawing Sheets

CARRYING BAG

BACKGROUND OF THE INVENTION

Various types of carrying bags are known in the prior art. However, what is needed is a carrying bag that includes an adjustable shoulder strap as well as an adjustable secondary strap that fits across a wearer's back and around an arm opposite the shoulder strap and that has a pouch integrally attached to a carrier body thereof, the pouch accessible by both a zipper and through an opening having a flap thereover.

FIELD OF THE INVENTION

The present invention relates to carrying bags, and more particularly, to a carrying bag which includes an adjustable shoulder strap and an adjustable secondary strap for increased security.

SUMMARY OF THE INVENTION

The general purpose of the present carrying bag, described subsequently in greater detail, is to provide a carrying bag which has many novel features that result in a carrying bag which is not anticipated, rendered obvious, suggested, or even implied by prior art, either alone or in combination thereof.

To accomplish this, the present carrying bag an elongated adjustable shoulder strap having a plurality of first snap receivers disposed along a central horizontal axis of the shoulder strap. Some of the first snap receivers are disposed proximal to the first end. At least one of the first snap receivers is centrally disposed on the shoulder strap while some of the first snap receivers are disposed proximal to the second end. An upper end of a carrier body snaps onto the shoulder strap. The upper end has a U-shaped indent centrally disposed therein and a protrusion disposed on each side of the indent, which allows a wearer to more easily slip the wearer's arm between the shoulder strap and the carrier body than if the upper end ran straight across. A pouch is disposed on a lower end of the carrier body. A flap snaps onto the carrier body to cover the upper side of the pouch thereby preventing items from fall out of the pouch. The present carrying bag also includes a securement strap. The securement strap includes a thin parallelepiped base member having slits in the corners thereof through which first and second elastomeric bands slide. One end of the first elastomeric releasably attaches to the shoulder strap. The second elastomeric band allows a wearer to slide an arm through an aperture formed by the second elastomeric band thus securing the carrying bag to the wearer's body. The elastomeric property of the bands permits a wearer to more easily don the securement strap around across the wearer's back and to insert one of the wearer's arms through the aperture while providing a tighter fit and better securement to the wearer than if the bands were not formed of a stretch material.

A zipper, which is centrally disposed along a horizontal axis of the pouch, provides alternate access to the pouch. A pocket, which is centrally disposed within the carrier body proximal to the lower end, is used to carry an item such as a cell phone or I-pod. Also, a waist belt is provided which has one end attached to the carrier body proximal to the rear wall. The waist belt provides another means of securing the carrying bag to a wearer.

The present carrying bag provides convenient storage for a variety of personal items and can be worn for a wide variety of activities, which includes during a physical workout thus eliminating the need to place personal items in an unsecured location, in a location in which the items would not be readily accessible, such as in a locker. Thus, the carrying bag permits a wearer ready access to personal items during an activity.

The present carrying bag may be worn at least a couple of different ways. One way is with the shoulder strap attached to the carrier body, a wearer inserts one arm between the shoulder strap and the carrier body, in a position which may be more convenient for a man. Another way for a woman to wear the carrying bag is with both the shoulder strap and the securement strap attached to the carrier body, a wearer inserts one arm between the shoulder strap and the carrier body and stretches the securement strap first elastomeric band across the wearer's back and places the opposite arm through the aperture of the second elastomeric band.

Thus has been broadly outlined the more important features of the present carrying bag so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
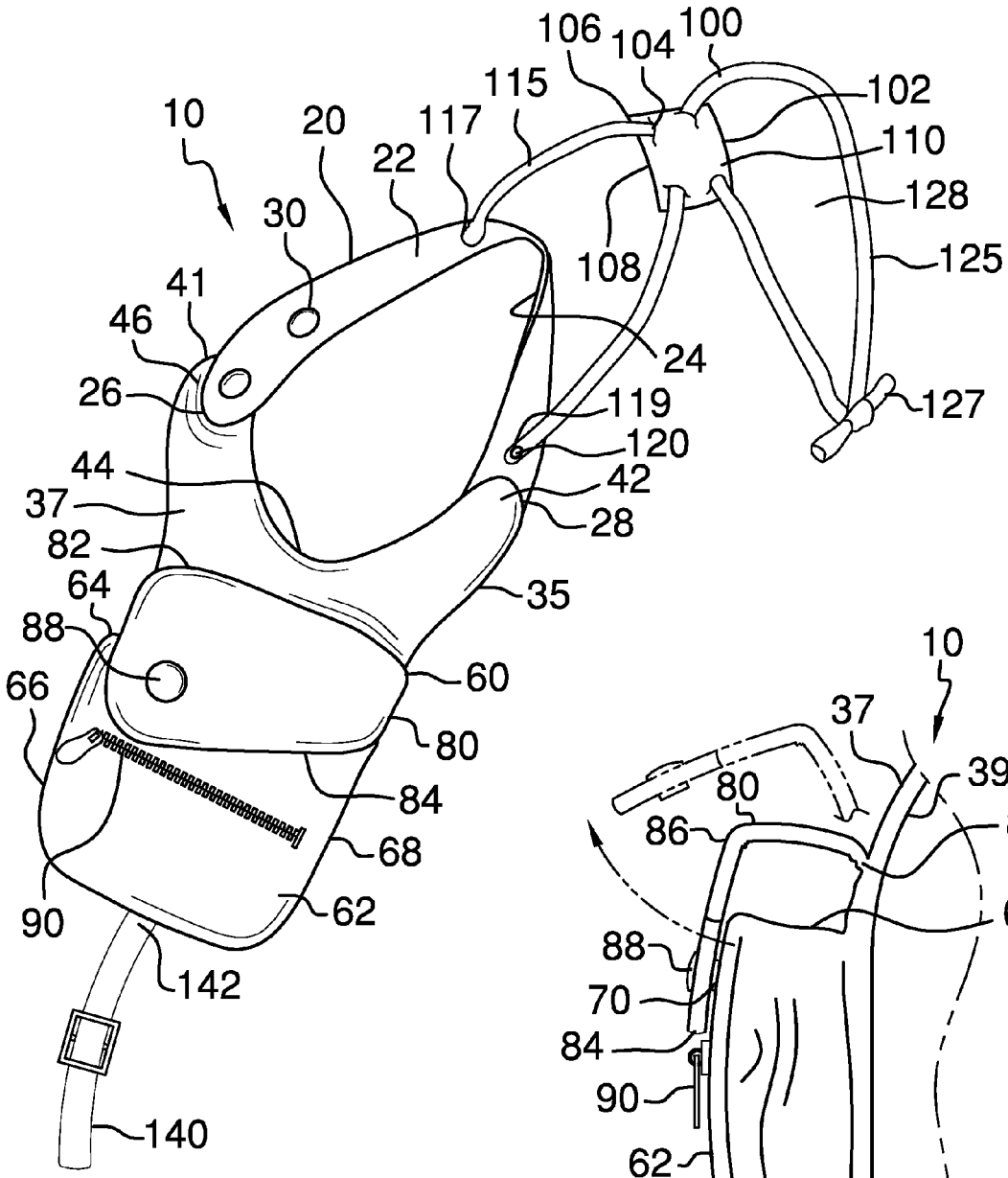
FIG. 1 is a front elevation view.
Figure 2:
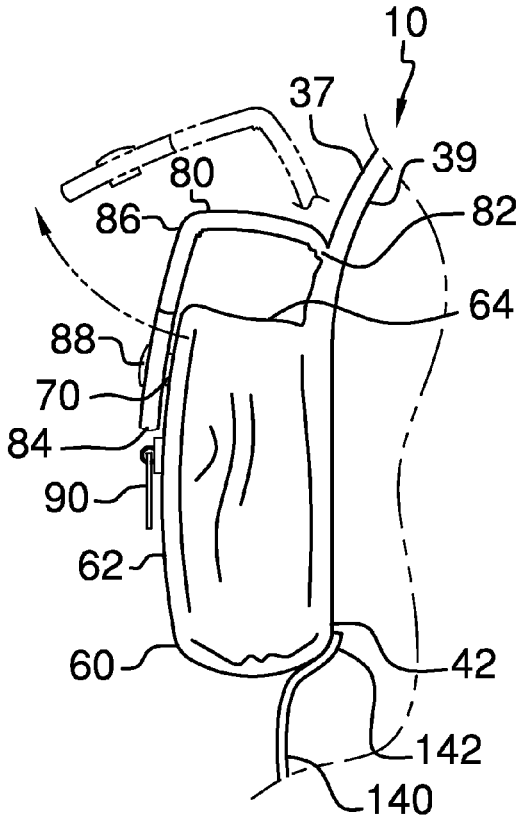
FIG. 2 is a side elevation view.
Figure 3:
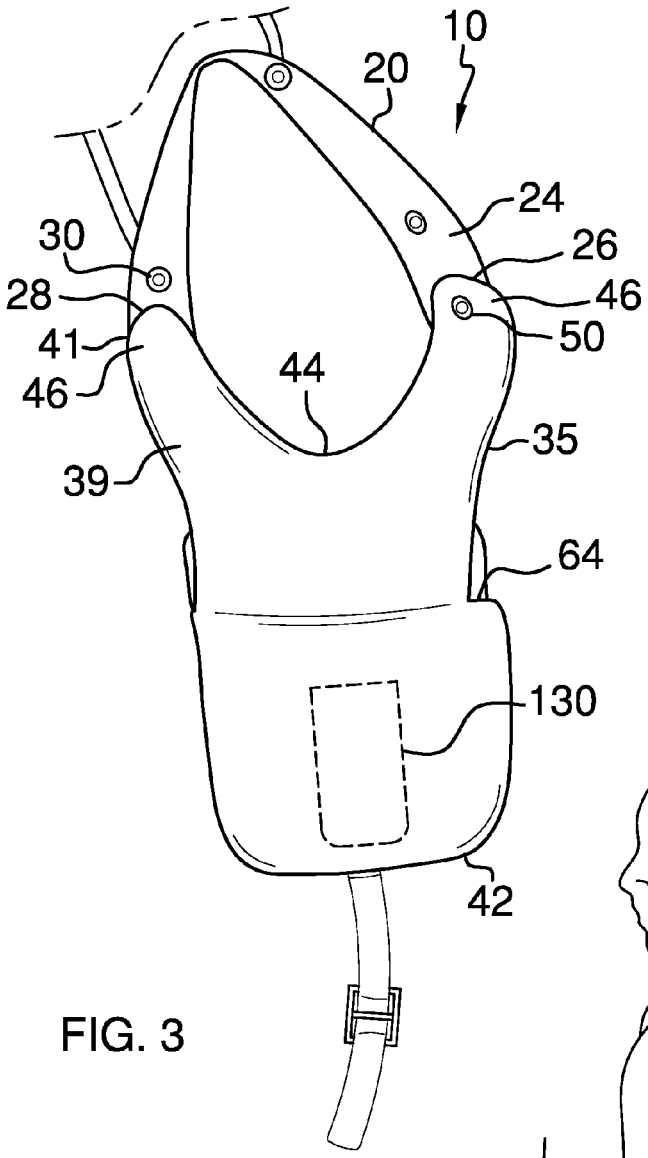
FIG. 3 is a rear elevation view.

With reference now to the drawings, and in particular FIGS. 1 through 5 thereof, example of the instant carrying bag employing the principles and concepts of the present carrying bag and generally designated by the reference number 10 will be described.

Referring to FIGS. 1 through 5 a preferred embodiment of the present carrying bag 10 is illustrated. The carrying bag 10 includes an elongated adjustable shoulder strap 20. The shoulder strap 20 has a top side 22, a bottom side 24, a first end 26, and a second end 28. A plurality of first snap receivers 30 is disposed along a central longitudinal axis of the shoulder strap.

Some of the first snap receivers 30 are disposed proximal to the first end 26. At least one of the first snap receivers 30 is centrally disposed on the shoulder strap 20 while some of the first snap receivers are disposed proximal to the second end 28.

The present carrying bag 10 also includes a carrier body 35 having a front wall 37, a rear wall 39, an upper end 41, and a lower end 42. The upper end 41 has a U-shaped indent 44 centrally disposed therein and a protrusion 46 disposed on each side of the indent 44. The U-shape of the indent 44 allows a wearer to more easily slip the wearer's arm between the shoulder strap 20 and the carrier body 35 than if the upper end 41 ran straight across. A first snap protuberance 50 is disposed on one of the protrusions 46. Each of the first snap receivers 30 disposed proximal to the shoulder strap 20 first end 26 alternately releasably engage the first snap protuberance 50, thus permitting adjustment of the length of the shoulder strap 20.

A pouch 60 is disposed on a lower end 42 of the carrier body 35. The pouch 60 is defined by the carrier body 35 rear wall 39, a front side 62, an upper side 64, a first side 66, and a second side 68. A second snap receiver 70 is disposed on the pouch 60 front side 62 proximal to upper side 64 and to the first side 66.

The carrying bag 10 also includes a flap 80. The flap 80 has a top end 82 integrally attached to the front wall 37 of the carrier body 35, a bottom end 84, and a bend 86 disposed between the top end 82 and the bottom end 84. A second snap protuberance 88 is disposed on the flap 80 proximal to the bottom end 84. The second snap protuberance 88 releasably engages the second snap receiver 70. The flap 80 and the attachment of its second snap protuberance 88 to the second snap receiver 70 prevents items from fall out of the pouch 60.

The present carrying bag 10 also includes an adjustable securement strap 100. The securement strap 100 includes a thin parallelepiped base member 102. The base member 102 has a slit 104 disposed proximal to each corner 106 of the base member 102. One pair of the slits 104 is disposed proximal to a forward end 108 of the base member 102 and another pair of the slits 104 is disposed proximal to a rearward end 110 of the base member 102. A first elastomeric band 115 slidingly engages the pair of slits 104 disposed proximal to the base member 102 forward end 108. The first elastomeric band 115 has a first outer end 117 releasably attached to the first snap receiver 30 centrally disposed on the shoulder strap 20 and an opposite second outer end 119. A third snap protuberance 120 is disposed on the second outer end 119. The third snap protuberance 120 releasably attaches to the first snap receiver 30 disposed proximal to the second end 28 of the shoulder strap 20. A second elastomeric band 125 slidingly engages the pair of slits 104 disposed proximal to the base member 102 rearward end 110. A retaining bar 127 is disposed on the second elastomeric band 125 allowing a wearer to slide an arm through an aperture 128 formed by the second elastomeric band 125 thus securing the carrying bag 10 to the wearer's body. The elastomeric property of the bands 115, 125 permits a wearer to more easily don the securement strap 100 around across the wearer's back and to insert one of the wearer's arms through the aperture 128 while providing a tighter fit and better securement to the wearer than if the bands 115, 125 were not formed of a stretch material.

A zipper 90 is centrally disposed along a horizontal axis of the pouch 60. The zipper 90 provides alternate access to the pouch 60. A pocket 130 is centrally disposed within the carrier body 35 proximal to the lower end 42. The pocket 130 is used to carry an item such as a cell phone or I-pod. The carrying bag 10 also includes a waist belt 140. The waist belt 140 has a proximal end 142 attached to the lower end 42 of the carrier body 35 proximal to the rear wall 39 of the carrier body 35. The waist belt 140 provides another means of securing the carrying bag 10 to a wearer.

The present carrying bag 10 provides convenient storage for a variety of personal items and can be worn for a wide variety of activities, which includes during a physical workout thus eliminating the need to place personal items in an unsecured location, in a location in which the items would not be readily accessible, such as in a locker. Thus, the carrying bag 10 permits a wearer ready access to personal items during an activity.

Figure 4:
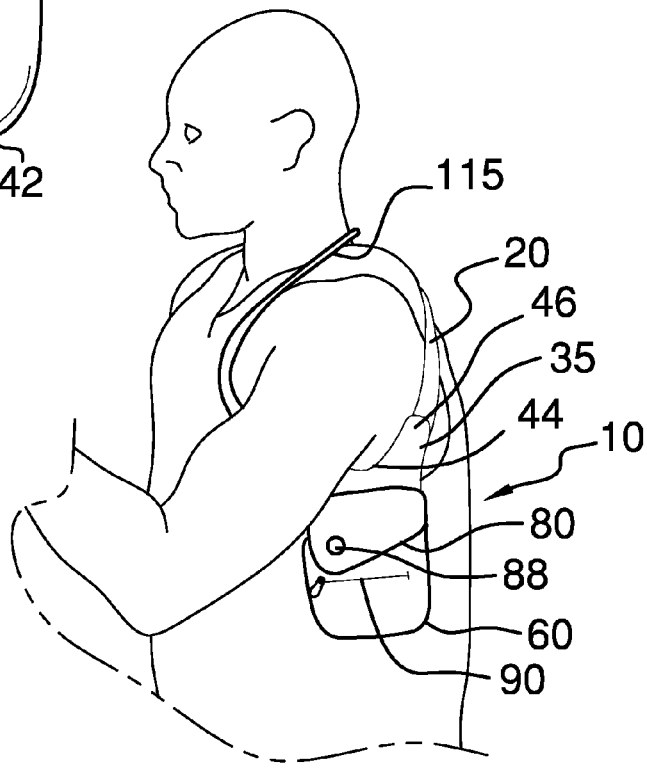
FIG. 4 is an isometric in-use view illustrated being worn by a man.
Figure 5:
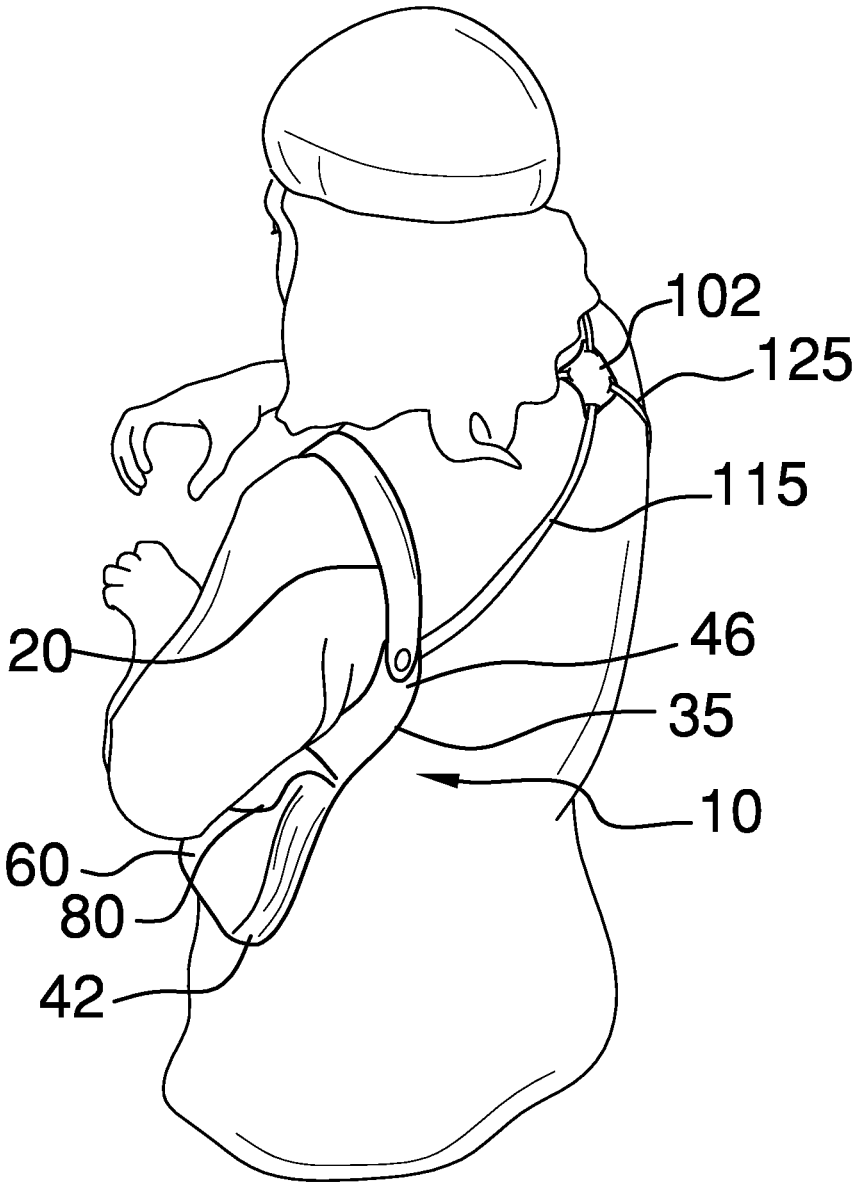
FIG. 5 is an isometric in-use view illustrated being worn by a woman.

Use:

The present carrying bag 10 may be worn at least a couple of different ways as shown in FIGS. 4 and 5. As shown in FIG. 4, with the shoulder strap attached to the carrier body 35, a wearer inserts one arm between the shoulder strap 20 and the carrier body. This position may be more convenient for a man. A way for a woman to wear the carrying bag 10 is shown in FIG. 5. With both the shoulder strap 20 and the securement strap attached to the carrier body 35, a wearer inserts one arm between the shoulder strap 20 and the carrier body 35 and stretches the securement strap first elastomeric band across the wearer's back and places the opposite arm through the aperture 128 of the second elastomeric band 125.

What is claimed is:

1. A carrying bag comprising:

an elongated adjustable shoulder strap having a top side, a bottom side, a first end, and a second end;

a plurality of first snap receivers disposed along a central longitudinal axis of the shoulder strap, each of the first snap receivers having a receiver disposed on the bottom side of the shoulder strap;

wherein some of the first snap receivers disposed proximal to the first end, at least one of the first snap receivers is centrally disposed on the shoulder strap; and some of the first snap receivers are disposed proximal to the second end;

a carrier body having a front wall, a rear wall, an upper end, and a lower end, the upper end having a U-shaped indent centrally disposed therein and a protrusion disposed on each side of the indent;

a first snap protuberance disposed on one of the protrusions, wherein each of the first snap receivers disposed proximal to the shoulder strap first end alternately releasably engage the first snap protuberance;

a pouch disposed on a lower end of the carrier body, the pouch defined by the carrier body rear wall, a front side, an upper side, a first side, and a second side;

a second snap receiver disposed on the pouch front side proximal to upper side and to the first side;

a flap having a top end integrally attached to the front wall of the carrier body, a bottom end, and a bend disposed between the top end and the bottom end;

a second snap protuberance disposed on the flap proximal to the bottom end, wherein the second snap protuberance releasably engages the second snap receiver;

an adjustable securement strap comprising:

a thin parallelepiped base member having a slit disposed proximal to each corner of the base member wherein one pair of the slits is disposed proximal to a forward end of the base member and another pair of the slits is disposed proximal to a rearward end of the base member;

a first elastomeric band slidingly engaging the pair of slits disposed proximal to the base member forward end, the first elastomeric band having a first outer end releasably attached to the first snap centrally disposed on the shoulder strap and an opposite second outer end;

a third snap protuberance disposed on the second outer end, the third snap protuberance releasably attached to the first snap disposed proximal to the second end of the shoulder strap;

a second elastomeric band slidingly engaging the pair of slits disposed proximal to the base member rearward end; and a retaining bar disposed on the second elastomeric band.

2. The carrying bag of claim 1 further comprising:

a zipper centrally disposed along a horizontal axis of the pouch.

3. The carrying bag of claim 2 further comprising:

a pocket central disposed within the carrier body proximal to the lower end.

4. The carrying bag of claim 3 further comprising:

a waist belt having a proximal end attached to the lower end of the carrier body proximal to the rear wall of the carrier body.

* * * * *